United States Patent [19]

Lindsey, Jr.

[11] Patent Number: 4,498,534

[45] Date of Patent: Feb. 12, 1985

[54] LINER HANGER ASSEMBLY

[75] Inventor: Hiram E. Lindsey, Jr., Midland, Tex.

[73] Assignee: MWL Tool and Supply Company, Midland, Tex.

[21] Appl. No.: 79,037

[22] Filed: Sep. 26, 1979

[51] Int. Cl.[3] ..... E21B 23/00

[52] U.S. Cl. ..... 166/208; 166/216; 294/86.25

[58] Field of Search ..... 166/208, 216, 217; 294/86.24, 86.25

[56] References Cited

U.S. PATENT DOCUMENTS

| | | | |
|---|---|---|---|
| 1,066,000 | 7/1933 | Crumpton | 166/216 |
| 2,134,287 | 10/1938 | Matlock | 166/216 |
| 2,174,076 | 9/1939 | Bowen | 294/86.25 |
| 2,670,045 | 2/1954 | Armentrout | 166/208 |
| 3,036,853 | 5/1962 | Sirucusa | 294/86.25 |

*Primary Examiner*—William F. Pate, III

[57] ABSTRACT

A liner hanger for use in an oil well completion comprising a hanger assembly which can be passed through a tubular pipe and has a continuous bypass and a shaped area for passing through fluid and cuttings in the pipe. The hanger assembly has an inclined cam surface which is spirally disposed along the length of a hanger body. A one-piece, heat treated, slip device comprised of strip of metal having an internal spiral and inclined cam surface is disposed up on the spiral cam surface on the hanger body. The spiral space around the hanger body provides a shaped bypass area. The spiral slip device is attached to setting means. Upon release of the setting means, relative movement between the slip device and the cam surface on the hanger body permits the slip device to be positioned in setting engagement with the inner wall of a tubular pipe.

4 Claims, 2 Drawing Figures

LINER HANGER ASSEMBLY

BACKGROUND OF THE INVENTION

This invention relates to a liner hanger for oil well completions, and more particularly, to a new and improved liner hanger for use in oil well completions which employs spiral slip means disposed along the length of the hanger body and complementary arranged for selective setting of the slip means in a well pipe.

In the drilling of oil wells, it is common practice to cement a tubular casing in the upper section of a drilled bore hole, the casing sometimes being referred to as "surface casing". After cementing the surface casing, the hole is again drilled for a suitable interval of depth and another casing typically is cemented in place. Successive intervals of depth in the well bore are drilled and cased and each such successive interval decreases in diametral size as a function of depth. In the use of pipe liners, a string of pipe is lowered into the drilled well bore to place the pipe in position. Then, the upper end of the string of pipe is anchored or supported at the lower end of the adjacent string of casing. The liner hanger at the upper end of the string of pipe has a supporting device which, when set, anchors and supports the depending string of pipe. It is obvious that such an anchoring and supporting device must support the substantial weight of the string of pipe depending below it. The depending string of pipe is sometimes limited in length to the weight of pipe that the anchoring and supporting device can support.

Typically, the anchoring and supporting device for a liner hanger consists of a tapered cone or cam surface with circumferentially spaced slip devices which are spaced from one another equidistantly around the circumference of the hanger body. To anchor the device, the slips and cones are moved longitudinally relative to one another from an "unset" condition to a "set" condition. The tapered cones cause the slips to be moved radially outwardly into anchoring engagement with the inner surface of the interior of the pipe casing. The outer surfaces of the slip have serrated or wickered surfaces which provide gripping engagement surfaces. Generally, either the tapered cone or the slips are attached to a tubular sleeve member which is slidably mounted on a body member. The sleeve device has external friction means for engaging the inner wall of the casing and a releasable locking device is provided between the sleeve member and body member which retains the slips and cones in an unset condition.

upon release of the locking device, the body member can move longitudinally relative to the friction means and the relative motion permits movement of the slips and cones to the set condition.

Typical types of mechanically set liners are illustrated in the composite catalog of Oilfield Equipment and Services, 33rd Revision 1978–1979, published by World Oil on pages 1062–1064 or page 6432. Other liner hangers which are set by hydraulic devices (which are commonly referred to as hydraulic set liner hangers) are described on pages 1062, 1074 and 6431 of the above described composite catalog.

It is extremely desirable and many times, necessary, in the design of a liner hanger to have the outer diameter of the hanger close as possible to the wall of the pipe. In other words, small clearances are necessary. For example, a 4 inch O.D. liner pipe is sized for passage through a $5\frac{1}{2}$ O.D. casing, or a $5\frac{1}{2}$ inch O.D. liner pipe is sized for passage through a 7 inch O.D. casing, or $7\frac{5}{8}$ O.D. liner pipe is sized for passage through a $9\frac{5}{8}$ inch O.D. casing. Where there is a minimal annular clearance space (or bypass area) between the outer surface of the liner hanger assembly and the inner surface of the pipe, it is difficult to pass the assembly through the fluids in the pipe because of the hydraulic effect which is produced. When the bypass area or clearance space between the liner hanger assembly and a string of pipe is restricted or limited, a number of things can happen when the liner hanger assembly is run through the casing. For example, pressure build-up below the hanger assembly can cause formation fracturing. Breakdown pressure gradients can be exceeded which result in lost circulation of fluids from the well bore. Where cement is involved, a restricted bypass area can cause premature gelling of cement if there is a slowdown in the circulation of the cement.

Prior attempts to solve liner hanger design problems involve, for example, the idea of creating narrow vertical spaces between adjacent cone segments and slips disposed about the circumference of a body member. Some solutions suggest providing vertical grooves or cuts vertically through an annular cone. It has also been suggested to vertically stagger sets of cone and slips along the length of a hanger assembly so that a multiple number of slips can be used for support of the pipe. Also, it has been suggested that vertically fluted or grooved cone surfaces be provided so that fluid is required to pass through narrow vertical channels.

In construction, sometimes the cones have been welded on the body of the pipe which will cause "hot spots". That is, the metalurgical characteristics of the pipe at the weld location are adversely affected. Where multiple, vertically staggered slip units are used, there is a lack of symmetry between the units so that uneven stress distributions occur in the units upon setting of the slips. Stress distributions can cause parts of the slip units to break off, and even cause the liner to fail and perhaps drop to the bottom of the well bore.

THE PRESENT INVENTION

The present invention contemplates a liner hanger anchor assembly in which the body of the liner hanger is provided with a spiral cam surface disposed along its length. This also provides a spiral bypass area around the body in the vertical space between the spiral cam surface. Interfitted over the spiral cam surface is a strip of slip material which forms a slip element. The slip element has a spiral configuration and is constructed with a complementary, internal cam surface to the spiral cam surface on the hanger body. The slip element has outer serrated surfaces for gripping engagement with the inner wall of a pipe. One end of the strip of slip material is attached to a friction block unit which, in turn, is releasably locked to the hanger body member. In the locked position, the slip element is in a retracted position or "unset" position relative to the spiral cam surface on the hanger body. Upon release from the locked position, the friction block unit permits relative longitudinal movement between body member and the friction block unit. Upon relative movement between the body member and the friction block unit, the cam surface on the body member urges the slip element to an extended position into gripping engagement with the wall of the casing.

It is accordingly an object of the present invention to provide new and improved apparatus for liner hangers which provide a large surface area for anchoring without minimizing the structural strength of the body member while providing a continuous bypass area for fluids.

BRIEF DESCRIPTION OF THE DRAWINGS

The foregoing object and other objects of the present invention may best be understood when taken in connection with the specification and the drawings in which.

DESCRIPTION OF PREFERRED EMBODIMENT

Figure 1:
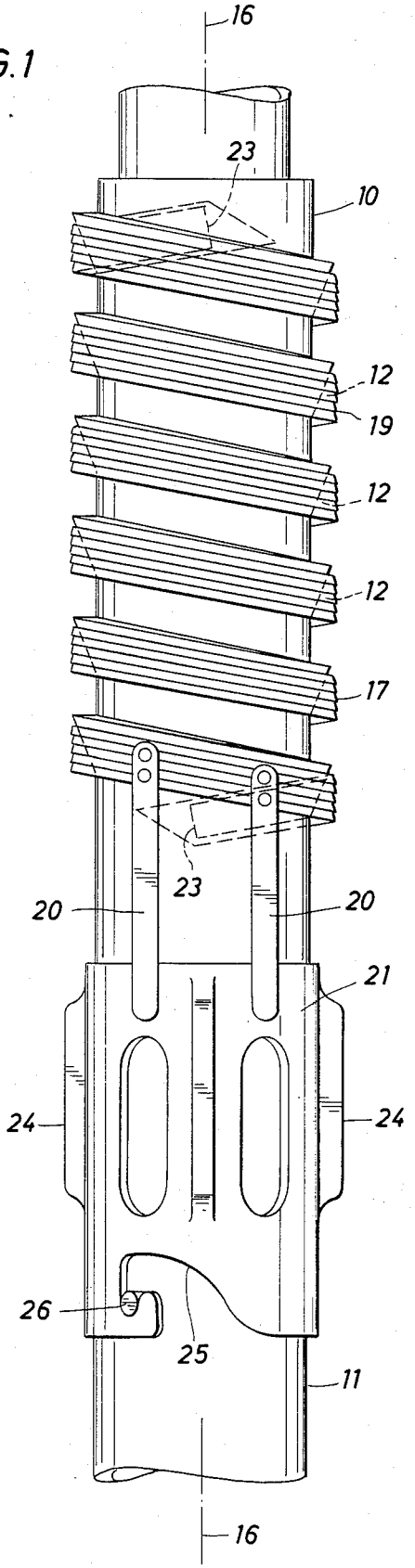
FIG. 1 illustrates an outer view of a liner hanger embodying the present invention with the anchoring mechanism in a retracted or unset position.
Figure 2:
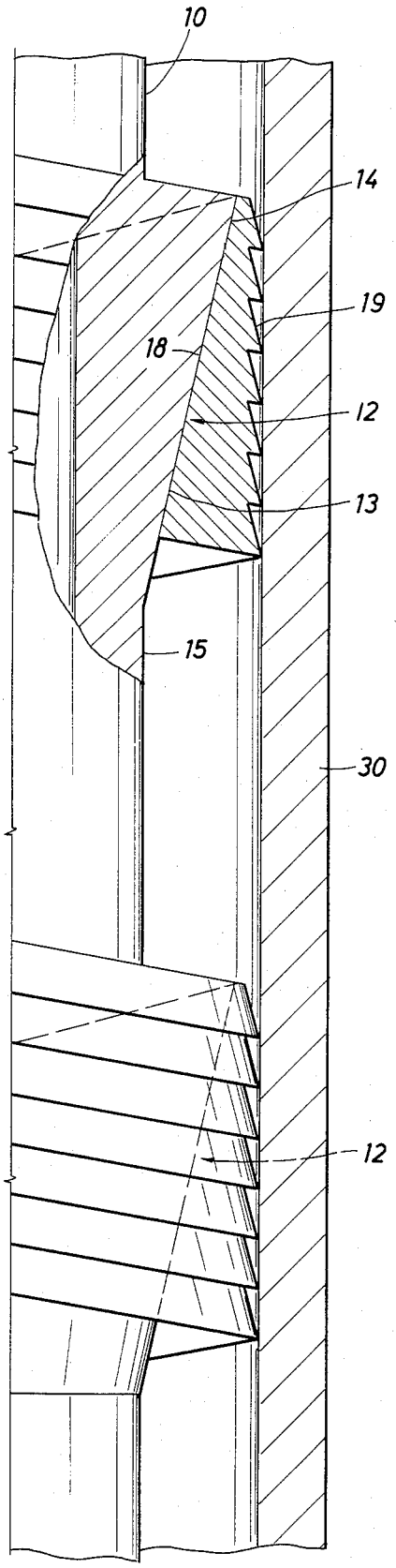
FIG. 2 illustrates an enlarged partial sectional view of the anchoring mechanism in an extended or "set" position with the slip element in gripping engagement with the wall of a pipe.

Referring now to FIG. 1, the present invention includes a hanger body member 10 which typically is a tubular member and is connected to the depending liner pipe 11. On the outer surface of the body member is a spiral surface 12 along its length which has a tapered cam surface 13. The tapered cam surface 13, in vertical cross section has an angular slope which tapers inwardly from an upper outer surface 14 to a lower inner 15 (FIG. 2). The lower surface generally corresponds to the outer diameter of the tubular body member 10.

The spiral surface 12 makes at least one full 360 degree turn around the vertical axis 16 of the hanger body member. The spiral surface 12 provides a continuous spiral bypass area on the spiral portion of the body member between the spiral surface 12. The bypass area has a substantial unrestricted cross-section which permits by passing of cuttings and fluid more easily.

An integral, one piece slip member is arranged to have a complementary spiral configuration arranged to fit on the spiral cam surface 12 on the hanger member body 10. Thus, the inner tapered surface 18 of the slip member 17, in the relaxed or "unset" position of the slip member, will have a complementary angular slope (in a vertical cross-section) to that of the inner cam surface 12 on the hanger body member 10. As illustrated in the drawing, the outer diameter of the slip member 17 is less than the outer diameter of the friction block member 21. In the relaxed or unset position of the anchor assembly the slip member 17 will pass through a string of pipe. The outer surface 19 of the slip member 17 has a serrated portion which provides gripping teeth and the outer surface 19 generally lies in a cylindrical plane disposed about the vertical axis 16 of the body member.

The lower-most end of the spiral slip member 17 is attached by vertical metal straps 20 to a tubular friction block member 21. The ends 23 of the slip member 17 are terminated short of the ends of the spiral surface 12. The friction block member 21 has circumferentially spaced, vertical spring members 24 which are arranged to frictionally engage the wall of a pipe member. At the lower end of the block member 21 is a conventional "J" slot 25 which cooperates with a "J" pin 26 to releasably lock the body member 10 to the body member 21.

To release the releasable locking mechanism in a string of pipe, the body member 10 is picked up by lifting up on the body member. The body member 10 is then rotated in a clockwise direction which will release the "J" pin 26 from the "J" slot. Thus, upon downward movement of member 10, there is relative longitudinal movement between the body member 10 and the friction block 21. Upon such relative longitudinal movement, the spiral cam surface 12 is moved downwardly relative to the spiral cam surface 18 on the slip member 19. The cam surface 12 urges the slip element outwardly and the slip element is enlarged radially relative to the central axis 16. Eventually, the outer serrated surface of the slip element 17 is extended outwardly a sufficient distance to be brought into gripping engagement with the inner wall of a pipe 30, as illustrated in FIG. 2.

The slip element 17 is a one-piece heat-treated metal member which is sized and constructed from a suitable material such as steel to have the necessary resilience for expansion. The tapered cam surfaces 13 and 18 are illustrated as complementary and it will be appreciated that this condition is desirable when the slip element is fully extended. Thus, the angular configuration of the surfaces 13 and 18 should be adjusted to provide this complementary arrangement upon setting of the slips. Further, it will be appreciated that setting of the anchor can be by hydraulic or other conventional setting mechanisms other than a friction drag block.

While only selected embodiments of the present invention are illustrated and described herein, other embodiments of the invention are contemplated and many changes and modifications of the inventions may be made within the scope of the appended claims without departing from the spirit of the invention.

I claim:

1. A liner hanger assembly for use in hanging a tubular string of pipe in a tubular casing in a well bore comprising:

tubular anchor body means adapted for connection to a tubular string of pipe, said tubular body means having an outer diameter sized relative to the inner diameter of a casing in a well bore to provide an annular clearance space therebetween, said tubular body means having a spiral surface along its length and disposed in said clearance space, said spiral surface extending outwardly toward an inner wall of a cased well bore, said spiral surface in vertical cross-section having a tapered configuration between an upper, outwardly extended shoulder portion and a lower outer diameter portion of said body means where the vertical space between a shoulder portion and the outer diameter portion of said body means above a shoulder portion defines a spiral bypass around the body means thereby to permit the clearance space to define a longitudinal fluid passageway, said spiral bypass being sized in cross-section to pass fluid and bore cuttings;

slip means on said body means, said slip means being constructed and arranged for anchoring engagement with the wall of a tubular member, said slip means being comprised of a spiral element of material having outer, serrated surface gripping means and inner tapered surface means disposed on said spiral surface on said body means so as to extend along the length of said body means within said clearance space;

said slip means being movable upon relative longitudinal movement between said body means and said slip means between an unset condition where the outer gripping means are proximate to but not in engagement with a cased well bore and a set condition where said gripping means are in gripping engagement with a cased well bore; and means for selectively permitting relative longitudinal movement between said body means and said slip means.

2. The hanger assembly as defined in claim 1 wherein said spiral slip element is constructed from a heat-treated steel material having sufficient resiliency to move from said unset condition to said set condition without creating undue stress in said material.

3. The hanger assembly as defined in claim 1 wherein said spiral slip element of said slip means extends for at least 360 degrees about a vertical axis of the body means.

4. The hanger assembly as defined in claim 1 wherein said tapered configuration on said body means is complementary to said inner tapered surface means.

* * * * *